United States Patent [19]

Kuriyama et al.

[11] Patent Number: 4,691,755

[45] Date of Patent: Sep. 8, 1987

[54] DEGASSING APPARATUS FOR A METAL MOLD

[75] Inventors: Minoru Kuriyama; Tadashi Yamamoto, both of Yamaguchi, Japan

[73] Assignee: Ube Industries, Japan

[21] Appl. No.: 942,091

[22] Filed: Dec. 15, 1986

[30] Foreign Application Priority Data

Dec. 24, 1985 [JP] Japan ..... 60-289421
Dec. 24, 1985 [JP] Japan ..... 60-289422

[51] Int. Cl.[4] ..... B22D 17/20

[52] U.S. Cl. ..... 164/305; 164/410; 425/420; 425/812

[58] Field of Search ..... 164/305, 410; 425/420, 425/812

[56] References Cited

U.S. PATENT DOCUMENTS 4,538,666 9/1985 Takeshima et al. ..... 164/305

*Primary Examiner*—Kuang Y. Lin
*Attorney, Agent, or Firm*—Darby & Darby

[57] ABSTRACT

A degassing apparatus, adapted for use in a molding apparatus having a mold cavity, includes a spool having a bore, a gas inlet opening and a gas outlet opening. The gas inlet and outlet openings are in selective communication and non-communication with each other. A reciprocatingly slidable valve body engages a conforming valve seat formed on the spool for selectively controlling the communication and non-communication between the gas inlet and gas outlet openings. A piston is mounted in the bore and coupled to the valve body. The piston is reciprocatingly slidable between a first position and a second position. First and second chambers are situated on opposite axial sides of the piston. First, second and third fluid ports are formed in the spool. The first and second ports are in communication with the first and second chambers, respectively. At least one first channel is formed in the piston and interconnects the first and second chambers, and a second channel formed in the piston interconnects the third port and the first chamber when the piston is in the first position. In the first position, the gas inlet and outlet openings are not in communication, and the molten material is prevented from flowing through the degassing apparatus. The third port and the first chamber are not in communication when the piston is in the second position. In this position, the gas inlet communicates with the gas outlet to allow gas to escape from the mold cavity.

16 Claims, 11 Drawing Figures

DEGASSING APPARATUS FOR A METAL MOLD

BACKGROUND OF THE INVENTION

1. FIELD OF THE INVENTION

The present invention relates to a degassing apparatus for a metal mold which degasses a cavity of the metal mold during injection molding by an injection molding apparatus, a die-cast machine or the like.

2. DESCRIPTION OF THE PRIOR ART

In a conventional injection molding apparatus, for example, a die-cast machine, when molten metal is charged in the mold cavity at high speed and high pressure, gas in the mold cavity cannot often be sufficiently removed and may become mixed with the molten metal used to form a product, thus forming a void in the molded product.

U.S. Pat. No. 4,431,047 ('047 patent) describes a degassing apparatus for a metal mold which can remove a large volume of gas within a short period of time. The degassing apparatus comprises a vent groove formed on the dividing or mating surfaces of the metal mold. The vent groove communicates with the mold cavity.

The apparatus described in the '047 patent also includes a valve having a reciprocatingly movable valve body, and a bypass conduit which provides a gas exhaust path from the mold cavity. The bypass conduit joins the vent groove midway along its length and connects with the valve. The valve body may be moved between an open and closed position. In the open position, the valve body allows gas from the bypass conduit to pass freely through the valve. In the closed position, the valve body blocks the bypass conduit and the vent groove so that no molten metal may pass into the valve. The valve body is positioned in line with the vent groove at an end of the groove that is distal from the mold cavity.

The degassing apparatus of the '047 patent allows gas in the mold cavity to escape during injection molding through the bypass conduit and the valve. When molten metal is charged in the cavity and reaches the end of the vent groove, the molten metal has sufficient mass to push the valve body from the open position to the closed position, whereupon the bypass conduit and vent groove are closed so that no molten metal can escape.

Although the degassing apparatus described in the '047 patent works satisfactorily in many applications, it has a number of inherent drawbacks.

One of the problems when injection molding with molten metal is that, like similar liquids, it travels in waves or splashes, so that its flow may be discontinuous. This is especially true when splashes or droplets of molten metal are entrained by the air escaping the mold cavity, which droplets comprise the leading wave of molten metal flow impinging the valve body.

The droplets of molten metal may not have sufficient mass to move the valve body completely from the open position to the closed position. In fact, a compression spring biasing the valve body towards the open position may reopen the valve after the first droplets of molten metal have impinged the valve body and upon the arrival of further gas escaping from the mold cavity through the bypass conduit.

When a subsequent, more continuous wave of molten metal reaches the valve body, the first leading droplets may have already begun to solidify within the vent groove and may form a constriction within the vent groove. Thus, the "after wave" of molten metal may not be capable of impinging the valve body with sufficient kinetic force to fully close the valve. As a result, molten metal may enter the valve through the bypass conduit.

U.S. Pat. No. 4,489,771 ('771 patent) discloses a degassing apparatus having a valve and a valve body, a tension spring for biasing the valve body in a closed position, and a leaf spring or a compression spring, a ball and a cooperating detent formed in the valve body for releasably locking the valve body in an open position. When molten metal impinges the valve body, it overcomes the pressure of the spring and ball, which is seated in the detent, and frees the valve body to move to the closed position, thus closing the valve. The valve can be quickly and reliably closed when the first wave of molten metal impinges the valve body.

An inherent disadvantage of the degassing apparatus of the '771 patent is that it relies on the mechanical forces between the biased ball and valve body detent to maintain the valve body in an open position. Such mechanical forces may vary as the leaf spring biasing the ball weakens, or due to undue wear on the ball or the detent in which the ball is seated. The valve may close prematurely as the locking mechanism weakens, which may prevent gas from the mold cavity from escaping.

Alternatively, if the leaf spring or other components of the locking mechanism become roughened or deformed, an unusually high kinetic force may be needed to dislodge the ball from the valve body detent. The molten metal impinging the valve body may not have sufficient kinetic force to close the valve, thus allowing the metal to flow into the valve.

Thus, the degassing apparatus of the '771 patent may not be able to withstand the strenuous and continual degassing operation that is required in mass production injection molding processes, and may have an unusually short operational life due to its mechanical wear.

OBJECTS AND SUMMARY OF THE INVENTION

It is an object of the present invention to provide a degassing apparatus for use in a metal molding apparatus which has high mechanical strength and increased reliability over conventional degassing apparatuses.

It is another object of the present invention to provide a degassing apparatus having a highly sensitive valve which will close with accurate repeatability upon the impingement by molten metal.

It is a further object of the present invention to provide a degassing apparatus which includes a mechanically simplified valve closing mechanism.

It is yet another object of the present invention to provide a degassing apparatus having an extended operating life.

It is a still further object of the present invention to provide a degassing apparatus which overcomes the inherent disadvantages of known degassing apparatuses.

It is still another object of the present invention to provide a degassing apparatus having a valve which is closed not only by the inertial force of a molten metal but also by an electrical signal during or before an injection molding process.

In accordance with one embodiment of the present invention, the degassing apparatus, which is adapted for use in a molding apparatus having a mold cavity, includes a spool having a bore formed longitudinally therein. The spool also has formed therein a gas inlet opening adapted to be communicatively coupled to the mold cavity of the molding apparatus, and a gas outlet opening.

The gas inlet and outlet openings are in selective communication and non-communication with each other. Thus, the apparatus will permit gas from the mold cavity to escape until such time as molten metal or other molding material reaches the degassing apparatus.

The degassing apparatus also includes a mechanism for selectively controlling the communication and non-communication between the gas inlet and gas outlet openings. In a preferred form of the invention, this mechanism may be in the form of a reciprocatingly slidable valve body which engages a conforming valve seat formed on the spool.

The degassing apparatus further has a piston mounted in the bore and coupled to the valve body or other inlet/outlet communication controlling mechanism. The piston is reciprocatingly slidable between a first position and a second position.

The bore is further formed with first and second chambers situated on opposite axial sides of the piston.

The spool further includes first, second and third fluid ports formed therein. The first and second ports are in communication with the first and second chambers, respectively.

The piston further includes at least one first channel formed therein and interconnecting the first and second chambers, and a second channel interconnecting the third port and the first chamber when the piston is in the first position. In the first position, the gas inlet and outlet openings are not in communication, and the molten material is prevented from flowing through the degassing apparatus.

The third port and the first chamber are not in communication when the piston is in the second position. In this position, the gas inlet communicates with the gas outlet to allow gas to escape from the mold cavity.

A pressurized fluid is provided selectively to the first, second and third fluid ports. In one form of the invention, by changing which ports receive the pressurized fluid, the piston may be made to move between the first and second positions or may be maintained in one of the positions. Alternatively, the degassing apparatus of the present invention is adapted to close upon molten material impinging the inlet/outlet communication controlling mechanism, such as the valve body. Furthermore, the valve may be closed not only by the inertial force of the molten metal but also by an electrical signal during or before an injection molding process.

Preferred forms of the degassing apparatus, as well as other objects, features and advantages of this invention, will become apparent from the following detailed description of illustrative embodiments thereof, which is to be read in connection with the accompanying drawings.

DETAILED DESCRIPTION OF THE PREFERRED EMBODIMENTS

FIGS. 1 to 4 show one embodiment of the present invention in which a degassing apparatus for a metal mold is applied to a metal mold of a die-cast machine (or other molding apparatus).

Figure 3:
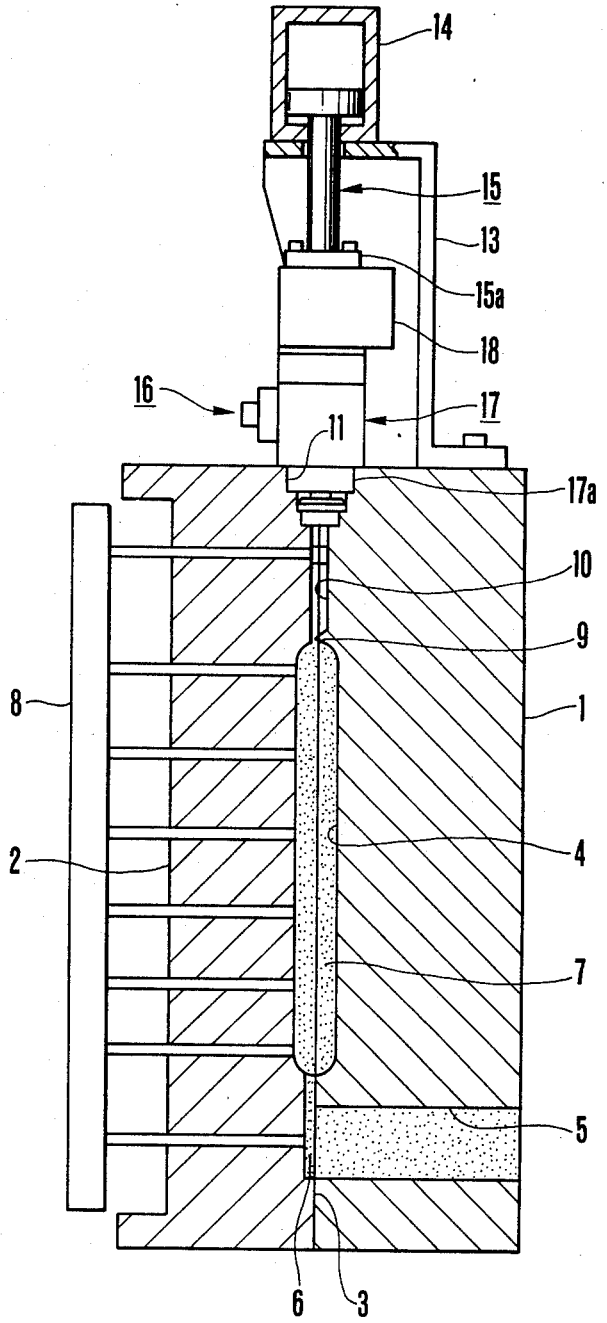
FIG. 3 is a partially cut away front view of the degassing apparatus and a molding apparatus.

As shown in the drawings, a typical molding apparatus includes a cavity 4 (FIG. 3) which is formed in two sides of a dividing surface 3 at the junction between a stationary metal mold 1 and a movable metal mold 2. The molding apparatus of FIG. 3 is illustrated in a closed state. A molten metal 7 is injected and charged in the cavity 4 from an injection sleeve (not shown) via a stationary sleeve 5 and a gate 6. Reference numeral 8 denotes a product pushing device for pushing out a molded product obtained by solidifying the molten metal 7 from the cavity 4 of the movable metal mold 2 after the molds are opened. A spool hole 11 communicating with the cavity 4 through a vent path 9, and a vent groove 10 formed between the vent path 9 and the spool hole 11 are provided in the upper end portion of the dividing surface 3 of the metal molds 1 and 2. A bypass conduit 12 branching midway along the vent groove 10 communicates with a portion of the vent groove 10, which is open to the spool hole 11.

A fluid pressure cylinder 14 is fixed to a bracket 13 that is mounted on the upper surface of the stationary metal mold 1 and is preferably concentric with the vent groove 10. A holder 18 for clamping the upper end portion of a spool 17 of the degassing apparatus (indicated generally by reference numeral 16) is mounted on a flange **15*a*, which serves as an operating end of a piston rod 15. The piston rod 15 reciprocates within cylinder 14** by varying the fluid pressure within the cylinder.

Figure 4:
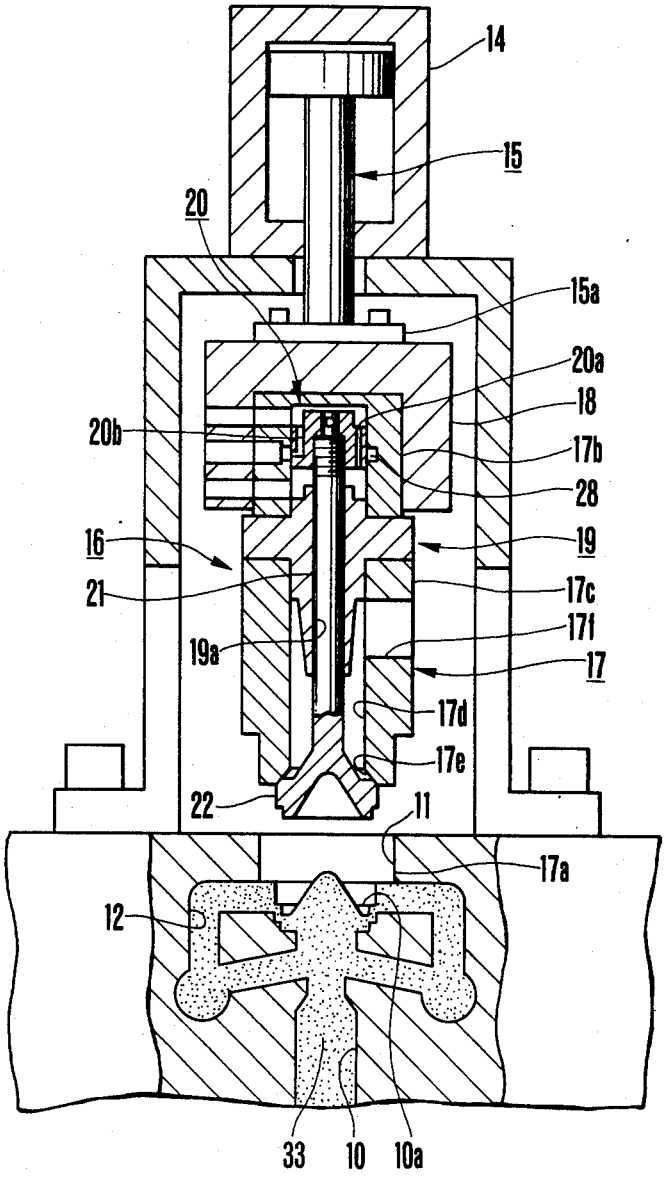
FIG. 4 is a longitudinal sectional view of the degassing apparatus shown in FIG. 1 separated from the molding apparatus.

The spool 17 of the degassing apparatus is preferably formed in a cylindrical shape at its lower end, and includes a stepped portion **17*a* at its lower end. Upon reciprocal movement of the piston rod 15, the entire degassing apparatus 16 moves vertically, so that the stepped portion 17*a* is received by the conforming spool hole 11 (so as to be in an enabled state), or is separated from the spool hole (so as to be in a disabled state), as shown in FIG. 4**.

Figure 1:
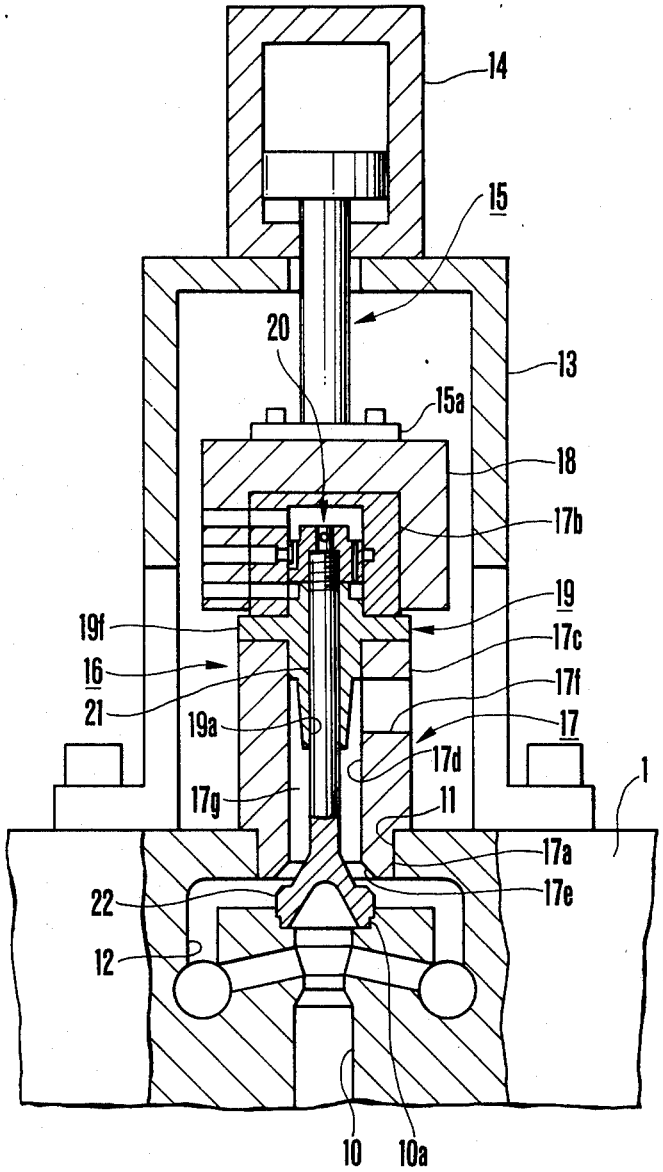
FIG. 1 is a longitudinal sectional view of the degassing apparatus of the present invention in accordance with one preferred embodiment thereof.

The degassing apparatus 16 will now be described with reference to FIGS. 1 to 3, which illustrate the apparatus in an enabled state.

In a preferred form, the spool 17 is divided into upper and lower members **17*b* and 17*c*, and a flange 19*f* which is fitted in an inner hole or bore 17*d* of a valve guide 19 and is clamped therebetween, thus integrating the upper and lower members 17*b* and 17*c* with the valve guide 19. Reference numeral 20 denotes a piston which is located above the valve guide 19 and is slidably fitted in the inner hole 17***d* of the spool 17. The threaded portion of a valve rod 21, which is slidably fitted in an inner hole or bore 19*a* of the valve guide 19, is screwed in the central threaded hole of the piston 20.

A valve body 22 is integrally formed on the lower end of the valve rod 21. A valve seat 17*e* is formed in a lower opening end of the spool 17. The valve body 22 and the valve seat 17*e* are arranged so that molten metal 7 moving upward along the vent groove 10 pushes the valve body 22 from the valve open state shown in FIG. 1 to a closed state, and the valve body 22 moves upward, thus closing the valve. In the valve open state shown in FIG. 1, the valve body 22 engages an opening stepped portion 10*a* of the vent groove 10 to close it. In FIG. 2, reference numeral 17*f* denotes an exhaust hole for externally exhausting gas from the mold cavity which is guided to a valve chamber 17*g* of the spool 17, which is defined by the inner hole 17*d* and the valve guide 19, in the valve open state.

The degassing apparatus 16 of the present invention in the preferred form described above has a pneumatic pressure type holding mechanism for keeping the valve body 22 in both the valve open state and the valve closed state, or alternatively, for causing the valve to open and close. More specifically, as shown in FIG. 2, the piston 20 has a small hole 20*a* communicating with a head-side chamber 23 and a rod-side chamber 24, which chambers are situated at the upper and lower sides of the piston 20, respectively. The piston also includes a hole 20*b* which allows the outer peripheral surface of the piston 20 to communicate with the head-side chamber 23, as well as the inner surface of the spool upper plate. In the preferred form of the invention, the diameter of the piston 20 is, e.g., 30 mm, one to several small holes 20*a* having a diameter of 2 to 3 mm are formed, and three to four holes 20*b* having a diameter of 2 to 3 mm are formed, so that the total sectional area of holes 20*b* is slightly larger than that of small holes 20*a*.

Ports 25 through 27 and an annular groove 28 are formed in the peripheral inner wall of the spool 17. When switching valve 30 is in the open state (SOL-B is energized), the port 25 allows the head-side chamber 23 to communicate with ambient air and thus be open to atmospheric pressure. Similarly, when switching valve 31 is in the open state (SOL-C is energized), the port 26 allows the rod-side chamber 24 to communicate with ambient air and to be open to atmospheric pressure. The annular groove 28 communicates with the head-side chamber 23 through the hole 20*b* when the valve body 22 is closed, and is closed by the outer peripheral surface of piston 20 when the valve body 22 is open. The port 27 communicates with the annular groove 28 and leads to the outer wall of the spool 17.

Figure 2:
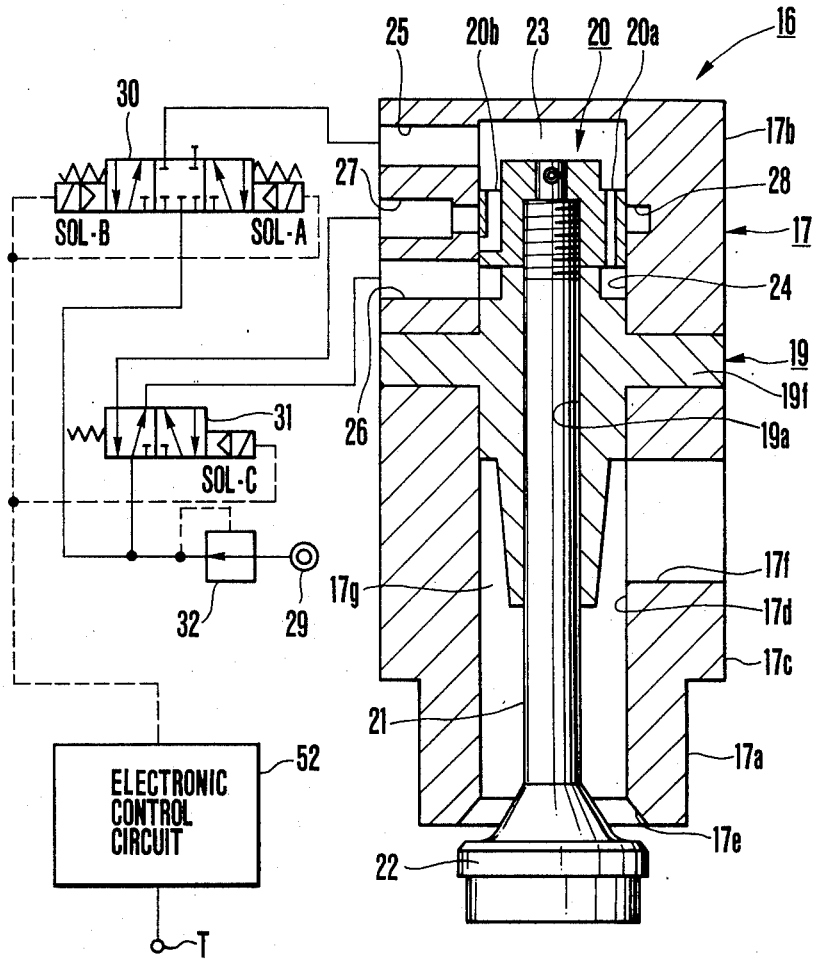
FIG. 2 is a longitudinal sectional view of the degassing apparatus of FIG. 1 viewed in a direction orthogonal to FIG. 1, and a pneumatic circuit diagram of a pneumatic control circuit adapted for use with the degassing apparatus.

A pneumatic circuit for opening and closing the valve is illustrated by FIG. 2. A switching valve 30 comprising solenoids SOL-A and SOL-B is arranged in series with a pipe or conduit connecting port 25 and a source of compressed air 29, and a switching valve 31 comprising a solenoid SOL-C is arranged in series with conduits connecting the ports 26 and 27 and the air source 29. Reference numeral 32 denotes a reducing valve or regulator for supplying a regulated supply of air to the circuit.

Solenoids SOL-A and SOL-B control the flow of pressurized air from source 29 to port 25. When SOL-A is energized and SOL-B is deenergized, port 25 is in communication with air source 29. When SOL-A is deenergized and SOL-B is energized, port 25 is open to atmospheric pressure. When both SOL-A and SOL-B are deenergized, port 25 is closed, that is, not open to atmospheric pressure and not connected to source 29.

Solenoid SOL-C controls the flow of pressurized air from source 29 to ports 26 and 27. When SOL-C is energized, port 26 is open to atmospheric pressure and port 27 is in communication with air source 29. When SOL-C is deenergized port 26 is in communication with source 29 and port 27 is open to atmospheric pressure.

With the circuit arrangement described above, when the solenoids SOL-A and SOL-C are deenergized and the solenoid SOL-B is energized (so that chamber 23 is open to atmospheric pressure and chamber 24 is exposed to pressurized air from source 29), and when the valve is in the valve open state (see FIG. 2), since air enters port 26 and is exhausted from port 25, the valve rod 21 moves upward and is held in the valve closed state. When the solenoids SOL-A and SOL-C are energized and the solenoid SOL-B is deenergized (so that chamber 23 is exposed to pressurized air from source 29 and chamber 24 is now open to atmospheric pressure), and when the valve is in the valve closed state, since air enters ports 25 and 27 and is exhausted from port 26, the valve rod 21 moves downward to be held in the valve open state.

The operation of the degassing apparatus described above, in conjunction with the operation of the molding apparatus illustrated by FIG. 3, will now be described in detail.

After the metal molds are closed, solenoids SOL-A and SOL-B of switching valve 30 (see FIG. 2) are respectively energized and deenergized, and solenoid SOL-C of switching valve 31 is energized, so that air enters ports 25 and 27 and is exhausted from port 26. In this situation, the resistance to the gas flow exiting port 26 from rod-side chamber 24 is much smaller than the resistance to the gas flow attributable by the small hole 20*a*, and the pressure at the head-side chamber 23 is sufficiently greater than that at the rod-side chamber 24 to cause the piston 20 to move downwardly until its lower end face abuts against the top portion of the valve guide 19, and the outer peripheral portion of the upper surface of the valve body 22 is separated from the valve seat 17*e* and the bypass conduit 12 to allow gas from the mold cavity to escape through the bypass conduit 12 into the valve. Since the valve is maintained in the valve open state by pneumatic pressure, the valve body 22 will not close inadvertently, even if molten material impinges the valve body.

When the valve is in the open state, solenoid SOL-C may be deenergized (while SOL-A and SOL-B are still energized and deenergized, respectively) so that pressurized air flows into port 26. This will cause the pressures in chambers 23 and 24 to be substantially equal to each other. However, the valve open position may be maintained because the cross-sectional area of chamber 23 is preferably greater than the cross-sectional area of chamber 24 (valve rod 21 occupies a portion of the rod-side chamber's area, reducing the effective area of chamber 24 to less than that of chamber 23), due to the fact that the force exerted on the piston is equal to the air pressure within a respective chamber multiplied by the area of the chamber. If the solenoid SOL-A is then deenergized (so that SOL-A, SOL-B and SOL-C are all deenergized), the pressurized air flows into head-side chamber 23 from rod-side chamber 24 through the small holes 20*a* and is exhausted from port 27 through the thin gap between the piston 20 and the inner peripheral surface of the spool 17 and through the annular groove 28. However, since the resistance on the exhaust air flow caused by the gap is much greater than the resistance attributable to the small holes 20*a* interconnecting the two chambers, the pressures in both chambers 23 and 24 are kept substantially equal to each other, and the valve is maintained in the open state due to the larger area of chamber 23 causing the exertion of a greater downward force on the piston 20.

Thereafter, as shown in FIG. 3, when molten metal or other molten material is supplied to a supply hole of an injection sleeve (not shown) and a plunger of an injection cylinder is moved forward, the molten metal 7 is injected and charged in the cavity 4 via the stationary sleeve 5 and the gate 6. At this time, with SOL-A, SOL-B and SOL-C deenergized, and with piston 20 in its lower position, and the valve body 22 separated from the valve seat 17*e*, the gas in the cavity 4 is discharged from the cavity and enters valve chamber 17*g* via the vent groove 10 and the bypass conduit 12, and is vented through the exhaust hole 17*f*. Although the gas flow strikes the lower end face of the valve body 22, the valve remains in the open state because of the small inertia of the gas.

After the molten metal 7 is substantially charged in the cavity 4, the molten metal 7 moves upward along the vent groove 10 and abuts against the recessed portion of the lower face of the valve body 22. In this case, the force applied to the valve body 22 by the molten metal pushes it up since the mass of the molten metal 7 is much larger than that of the gas and, consequently, its inertia is also large. As a result, the holes 20*b* of piston 20 are brought into communication with port 27, and pressurized air inside the head-side chamber 23 is discharged through port 27. The pressure in chamber 23 thus drops quickly to below that in chamber 24. Then, since the piston 20 moves upward quickly by the inertial force of the molten metal 7, supplemented by the force exerted by the higher gas pressure in chamber 24, the valve body 22 closes the bypass conduit 12, thereby shutting off the vent groove 10 and the bypass conduit 12 from the valve chamber 17*g*. Therefore, the molten metal 7 is preventing from flowing further than the closed position of valve body 22. Since the resistance to air flow cause by holes 20*b* is sufficiently less than that caused by small holes 20*a*, the air pressure inside the head-side chamber 23 becomes much less than that inside rod-side chamber 24, and the piston 20 is forced upwardly toward the head-side chamber end of the valve to close the valve, not only by the force of the molten metal 7 but also by the force of the pressurized air, thus keeping the valve closed. Even if molten metal 7 is entrained by the gas and discontinuously strikes the valve body 22 in the form of splashes or droplets, the valve body 22 is pushed upward by the first wave of molten metal 7 striking the valve body 22, and a gas exhaust path can be reliably closed merely by the force of the pneumatic pressure within the valve without the upward inertial force of the molten metal 7.

After the molten metal 7 has compressed and cooled for a predetermined period of time following the valve body 22 closing the vent groove 10 and the bypass conduit 12, the entire degassing apparatus 16 is moved upward by the cylinder 14, as shown in FIG. 4, so that a solidified metal 33, which has filled the cavity 4, the vent groove 10, and the bypass conduit 12 may be separated from the valve body 22. Thereafter, the movable metal mold 2 is moved to open the molds, and a molded product is then removed from the mold by the product pushing device 8. When the entire degassing apparatus 16 is moved upward by the cylinder 14, the solidified metal 33 adheres to the valve body 22, pulling the valve body down to its initial open state. Thus, the valve is opened, and may be maintained in the valve open position by controlling the pressure in chambers 23 and 24 through switching valves 30 and 31.

Of course, it is envisioned that the degassing apparatus may be operated to open and close independently of whether or when the molten metal actually impinges the valve body 22. For example, if it is known how long it takes for the molten metal to charge the mold cavity and reach the vent groove 10 or bypass conduit 12, a switch (not shown) located on an injection ram of the molding apparatus may be used to signal the start of the molding process and the injection of molten material into the mold. Alternatively, a temperature sensor (not shown) may be arranged adjacent to the path of the molten metal in the metal molds to detect the flow of the molten metal and to close the valve in response to the sensor output. A signal from the switch or from the temperature sensor may be provided to a terminal T of an electronic control circuit 52 (see FIG. 2). In response to the signal from the switch or sensor, the electronic control circuit 52 supplies a control signal to switching valves 30 and 31 for energizing or deenergizing the switching valves, for example, after a predetermined time from when the event which triggered the switch or sensor occurred. Thereafter, the selected valve connects air pressure source 29 with the corresponding port to provide pressurized air to the corresponding port in order to cause valve body 22 to move to the valve closed state.

By using control circuit 52, the opening and closing of the degassing apparatus may be precisely controlled after a predetermined event occurs and without relying on the molten metal 7 to trip the valve.

As is well known in conventional degassing apparatuses, a gas exhaust hole, such as hole 17*f* in accordance with the present invention, formed in a spool can be open to air or can be connected to a vacuum suction device. A valve of the apparatus can be closed in response to an electrical signal during injection with normal molten metal flow. In this case, if the electrical signal is delayed so that it is not supplied to the valve at the proper time to close the valve, the molten metal may enter the valve apparatus before the valve closes in response to the signal, resulting in unstable operation of the degassing apparatus. However, with the present invention, since the valve can be closed by the inertia of the molten metal before the valve is closed by the delayed electrical signal during the injection process, the valve closing operation can always be reliably performed, thus assuring a safe, continuous operation over a long period of time.

In the embodiment described with reference to FIG. 2, when the valve body 22 is to be opened, air pressure is applied to the head-side chamber 23 of piston 20 and the central port 27 and the rod-side chamber 24 of piston 20 is opened to atmospheric pressure. On the other hand, when the valve body 22 is to be closed, the head-side chamber 23 and the central port 27 are released to atmospheric pressure, and pressurized air is applied to the rod-side chamber 24. When the valve body 22 is open and maintained in the open state, and when the valve body is closed after being struck by the molten metal and maintained in the closed state, air pressure is applied to chambers 23 and 24, so that port 27 is open to atmospheric pressure. The above described operation can be replaced with other suitable operational steps and using other switching valves or fluid pressure circuits, all of which are envisioned to be within the scope of this invention.

For example, when the valve body 22 is to be opened, the entire fluid pressure can be applied to the head-side chamber 23, the rod-side chamber 24, and the port 27. In this situation, since a force (pressure × area) applied to the piston on the head-side chamber 23 is greater than that applied to the rod-side chamber 24, the valve body 22 will move into an open position. Air pressure is applied to the head-side chamber 23 to set the rod-side chamber 24 and the port 27 in the closed state. When the fluid pressure is applied to the head-side chamber 23, the piston 20 can be moved in the valve opening direction in such a manner that the pressurized air inside the rod-side chamber 24 moves toward the head-side chamber 23 through the small holes **20*a* formed in the piston 20**.

When the valve body 22 is in the closed position, unlike the operation described above, the head-side chamber 23 can be open to atmospheric pressure, and pressurized air can be applied to the rod-side chamber 24, thus closing port 27 by the upward movement of the piston. More specifically, when the fluid pressure is applied to the rod-side chamber 24 and the head-side chamber 23 is open to atmospheric pressure, port 27 can either be open to atmospheric pressure or be in a closed state.

In the embodiment described previously, when the valve body 22 is maintained in the open or closed state, the pressurized air is applied to the head-side chamber 23 and the rod-side chamber 24, and the port 27 is open to atmospheric pressure. In the valve open state, the force acting on the head-side chamber 23 is greater than that applied to the rod-side chamber 24. After the valve body 22 has closed under the inertial forces of the molten metal striking the body 22, the pressurized air in the head-side chamber 23 is exhausted externally through the holes **20*b* and port 27 communicating with the holes 20*b*, and the valve may be maintained in the closed state by the air pressure acting on the rod-side chamber 24, as well as by the resistance to air flow caused by the small holes 20*a*. Alternatively, the rod-side chamber 24 can be set in the closed state, and pressurized air can be applied to the head-side chamber 23 so that the port 27 is open to air. In this case, the head-side chamber 23 is in the closed state. If air pressure is applied to the head-side chamber 23 while the valve is in the valve open state, the air in the rod-side chamber 24 flows into the head-side chamber 23 through the small holes 20*a*. Therefore, the pressures in the chambers 23 and 24 become substantially equal to each other, and the force acting on the head-side chamber 23 becomes greater than that applied to the rod-side chamber 24 due to the difference in area between the chambers 23 and 24. As a result, the piston 20** is pushed in the valve opening direction, and the valve is maintained in the open state.

Figure 5:
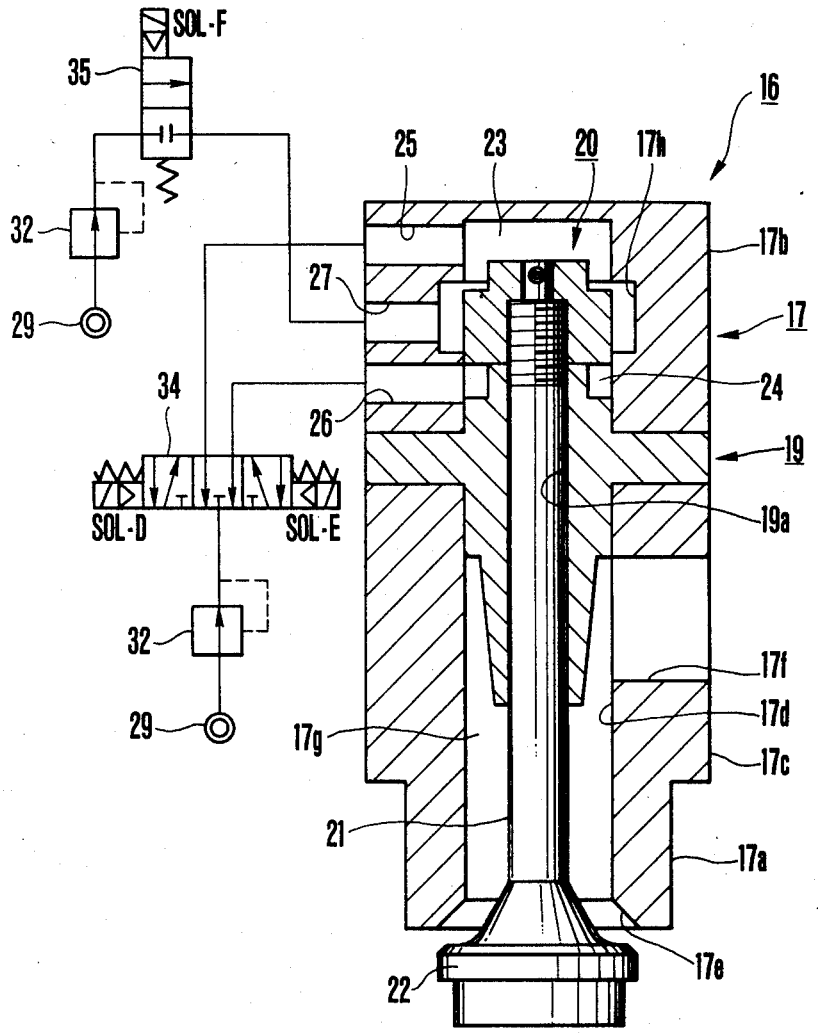
FIG. 5 is a longitudinal sectional view of the present invention in accordance with another preferred embodiment thereof, and a pneumatic circuit diagram of a pneumatic control circuit adapted for use with the degassing apparatus.

FIG. 5 is a longitudinal sectional view of the main part of the degassing apparatus of the present invention according to another embodiment. As can be seen from a comparison of FIGS. 2 and 5, the embodiment described previously is similar in many respects to the embodiment which will now be described. The same reference numerals as in FIG. 2 denote the same parts in FIG. 5, and a detailed description of such similar parts will be omitted.

In the embodiment of FIG. 5, a piston 20A does not have the small holes **20*a* and holes 20*b* of the previously described embodiment. An annular groove 17*h* having substantially the same width as the axial length of the peripheral edge of the piston 20A is formed in a portion of the spool 17 corresponding to the central port 27. In the valve open state shown in FIG. 5, the annular groove 17*h* communicates with the head-side chamber 23, thus providing communication between the ports 25 and 27. In the valve closed state, the annular groove 17*h* communicates with the rod-side chamber 24, thus providing communication between the ports 26 and 27**.

In addition, a switching valve 34 for selectively connecting one of ports 25 and 26 to an air source 29 is connected to the ports 25 and 26, and a switching valve 35 is arranged in series with a pipe or conduit connecting the central port 27 and the air source 29.

Switch 34 includes two solenoids, SOL-D and SOL-E, which control the flow of pressurized air from source 29 to ports 25 and 26. When SOL-D is energized and SOL-E is deenergized, port 25 is open to atmospheric pressure and port 26 is in communication with pressurized air source 29 through regulator 32. When SOL-D is deenergized and SOL-E is energized, port 25 is in communication with air source 29, and port 26 is open to atmospheric pressure. When both SOL-D and SOL-E are deenergized, both ports 25 and 26 are open to atmospheric pressure.

Switch 35 includes one solenoid, SOL-F, which controls the flow of pressurized air from source 29 to port 27. When SOL-F is deenergized, port 27 is closed, that is, not open to atmospheric pressure and not connected to source 29. When SOL-F is energized, port 27 is in communication with air source 29.

With this arrangement, in the state wherein solenoid SOL-F is deenergized, when solenoid SOL-D is energized (and SOL-E is deenergized), the valve body 22 moves to the valve closed position. When solenoid SOL-E is energized (and SOL-D is deenergized), the valve body 22 moves to the valve open position. After the valve has opened, when the solenoid SOL-F is energized and the solenoid SOL-E is then deenergized, since port 27 communicates with the head-side chamber 23, air is discharged from port 27 to the atmosphere through the head-side chamber 23 and the switching valve 34. Since almost no air flows from the rod-side chamber 24 through the switching valve 34, a pressure generated by the air resistance of the exhaust path of the head-side chamber 23 is applied to the upper surface of the piston 20A, thus holding the valve in the open state. When the inertial force of molten metal 7 is applied to the lower end face of the valve body 22 and the piston 20A moves upward to a given level or higher, the peripheral surface of piston 20A engages the upper edge of annular groove **17*h* and effectively closes the communication between the port 27 and the head-side chamber 23. However, the piston movement causes port 27 and the rod-side chamber 24 to communicate with each other, which causes the valve to close. The valve is maintained in the valve closed state by the higher resistance to air flow exhibited by the rod-side chamber 24 and the switching valve 34**.

FIGS. 6 to 9 are longitudinal sectional views showing various spool head portions according to other embodiments of the present invention. The same reference numerals as in FIG. 2 denote the same parts in FIGS. 6 to 9, and a detailed description thereof will be omitted. However, it should be noted that small holes 20*a* and holes 20*b* in the previously described embodiments are not used in the embodiments of FIGS. 6 to 9.

Figure 6:
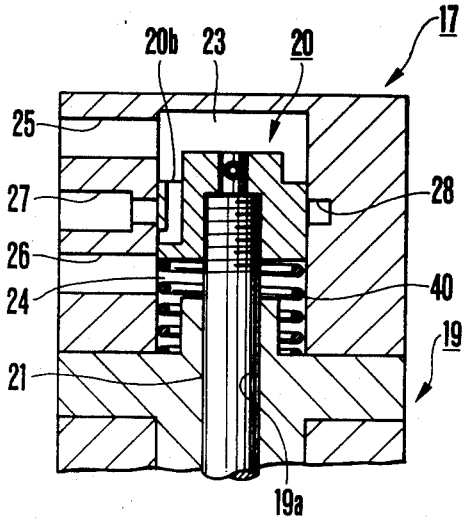
FIGS. 6–9 are longitudinal sectional views of alternative embodiments of portions of the degassing apparatus of the present invention.

As shown in FIG. 6, a compression coil spring 40, arranged between a piston 20 and a valve guide 19, for biasing the piston 20 toward a head-side chamber 23 is arranged in a rod-side chamber 24, and air always enters a port 25 and is exhausted from a port 27. When no upward force is exerted on the piston by the molten metal 7, the air pressure of the head-side chamber 23 is larger than the upward biasing force of the compression coil spring 40 and, hence, the piston 20 moves downwardly against the biasing force. As shown in FIG. 6, since the piston 20 closes a central port 27, the piston 20 maintains its lower position, i.e., a valve open position. As described above, when the molten metal 7 is charged and exerts an upward force on the piston 20, the upward force and the biasing force of the compression coil spring 40 combine to overcome the air pressure in the head-side chamber 23, and the piston 20 moves upwardly to allow holes 20*b* and port 27 to communicate with each other. Thereafter, air in the head-side chamber 23 discharges from port 27 through holes 20*b* of the piston 20, and the piston 20 is maintained at its upper position in a valve closed state.

Figure 7:
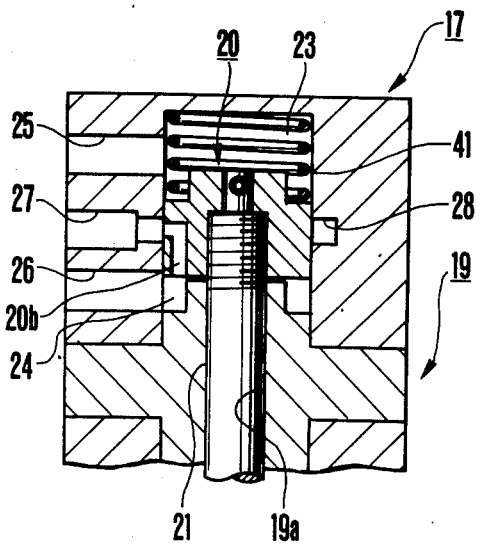

In the embodiment shown in FIG. 7, a compression coil spring 41 is arranged in the head-side chamber 23 between a piston 20 and the upper plate of a spool 17, and biases the piston 20 toward the rod-side chamber 24. Air always enters the valve through a port 26 and is exhausted from a port 27. Holes 20*b* formed in the piston are open to the rod-side chamber 24. When no upward force is exerted on the piston by the molten metal 7, the piston 20 moves downwardly under the biasing force of the compression coil spring 41, and holes 20*b* communicate with the central port 27. Air in the rod-side chamber 24 is exhausted from port 27 through the holes 20*b* of the piston 20, and the piston 20 is maintained in its lower position, thus holding the valve in the open state. When the molten metal 7 is charged and exerts an upward force on the piston 20, the upward force and the pneumatic pressure in the rod-side chamber 24 combine to overcome the biasing force of the compression coil spring 41, and the piston 20 moves upward, thus closing port 27. Therefore, piston 20 can be maintained in its upper position by the pneumatic pressure in the rod-side chamber 24, thus holding the valve in the open state.

Figure 8:
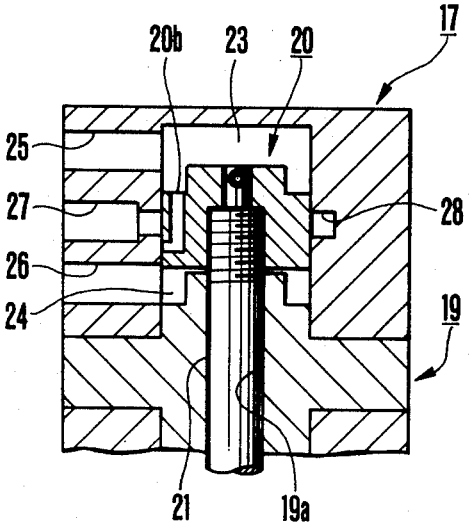

In the embodiment shown in FIG. 8, air always enters ports 25 and 26 and is exhausted from port 27. When no upward force is exerted on the piston 20 by the molten metal 7, piston 20 moves downward due to the difference in the areas of the head-side chamber 23 and the rod-side chamber 24, and thus closes port 27. The piston 20 is maintained at its lower position by the pneumatic pressure in the head-side chamber 23, thus holding the valve in the open state. When the molten metal 7 is charged and exerts an upward force on the piston 20, the upward force and the pneumatic pressure in the rod-side chamber 24 combine to overcome the pneumatic pressure in the head-side chamber 23, and the piston 20 moves upward, thus allowing holes 20*b* formed in the piston 20 to communicate with port 27. The pneumatic pressure in the head-side chamber 23 is consequently reduced by discharging the air through port 27, and piston 20 is maintained at its upper position, thus holding the valve in the open state.

Figure 9:
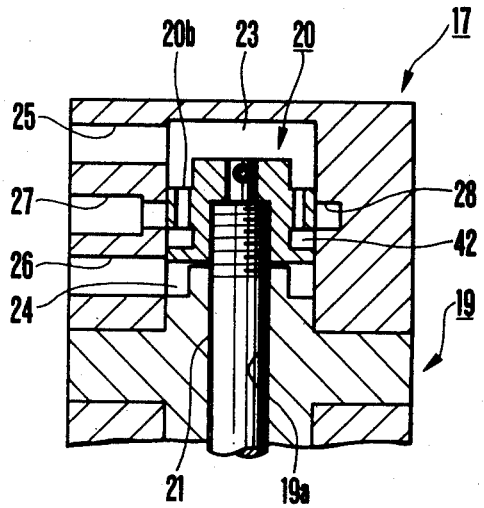

In the embodiment shown in FIG. 9, an annular groove 42 is formed in the periphery of the piston and communicates with a series of holes 20*b* that are open on one end to head-side chamber 23. The annular groove 42 is adapted to communicate with central port 27 upon movement of piston 20. With this arrangement, the resistance caused by holes 20*b* with respect to the airflow is reduced, which allows the piston 20 to move vertically smoothly and to be maintained in the valve opened and closed positions. This modification may be applied to each of the embodiments of the present invention described previously.

In the present invention, when the valve body 22 moves to the valve open position, the valve may be maintained in the open state. After the valve body 22 is moved to the valve closed position due to the force of the molten metal impinging the valve body during the injection molding process, or by an electrical signal generated during the injection molding process, the air pressure in the head-side chamber of the piston is automatically relieved, so that the valve body may be maintained in the valve closed state.

Compressed air is normally used as the fluid for holding the valve open or closed. When a working oil is used as the fluid, a hydraulic pressure pump must be used as a fluid supply source, and the exhaust ports of the respective switching valves must be connected to an oil tank through conduits or pipes. In the above embodiments, the present invention has been exemplified with reference to the metal molds of the diecast machine, but can be similarly applied to the molds of an injection molding machine.

As is apparent from the above descriptions of illustrative embodiments of the present invention, the degassing apparatus for metal molds includes a piston fitted in an inner bore or hole of a spool, which piston is fixed to an end portion of a valve rod at a side opposite to a valve body. Two ports are provided which respectively open to a rod-side chamber and a head-side chamber, and a central port is provided which is closed by the outer peripheral surface of the piston or which communicates with the rod-side chamber or the head-side chamber. These ports, and a pressurized fluid source, are connected through pipes or conduits having switching valves. When the valve body is in the valve open state during degassing, the valve open state is maintained by the pressure difference between the head-side chamber and the rod-side chamber. during the injection molding process, after the molten metal impinges the valve body to close the valve, the pressure in the head-side chamber is automatically relieved, thus maintaining the valve in the closed state. Therefore, unlike a conventional degassing apparatus using a leaf spring, ball and detent to hold the valve in a particular state, there are no similar mechanical parts which can wear over extended periods of use, and the holding force at the open and closed positions can be reliably maintained over a long period of time, thus considerably improving the mechanical strength and reliability of the apparatus. Since the valve can always be satisfactorily operated and gas exhaustion during injection can be reliably performed, a good injection product having a high mechanical strength without void area caused by entrained gas can be easily obtained. The number of components used in the degassing apparatus is significantly reduced from that of conventional degassing apparatuses, which allows for easy maintenance. In addition, the holding force at the valve open position can be easily adjusted by changing the reducing valve or regulator.

Figure 10:
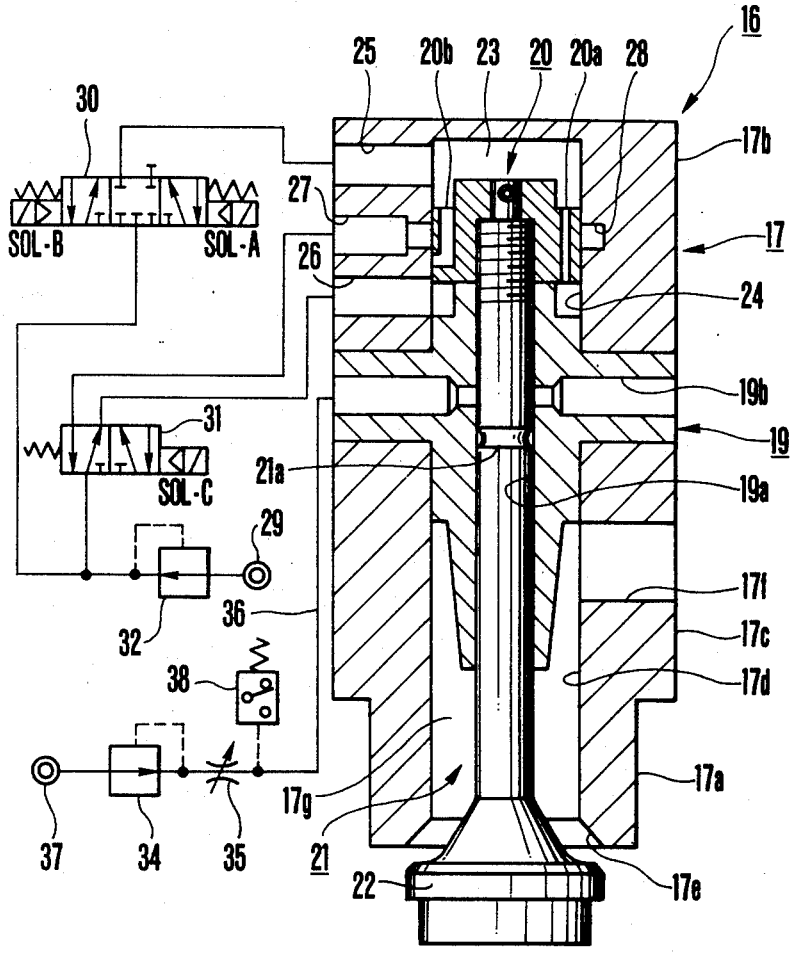
FIGS. 10 and 11 are longitudinal sectional views of the present invention in accordance with a third preferred embodiment thereof.
Figure 11:
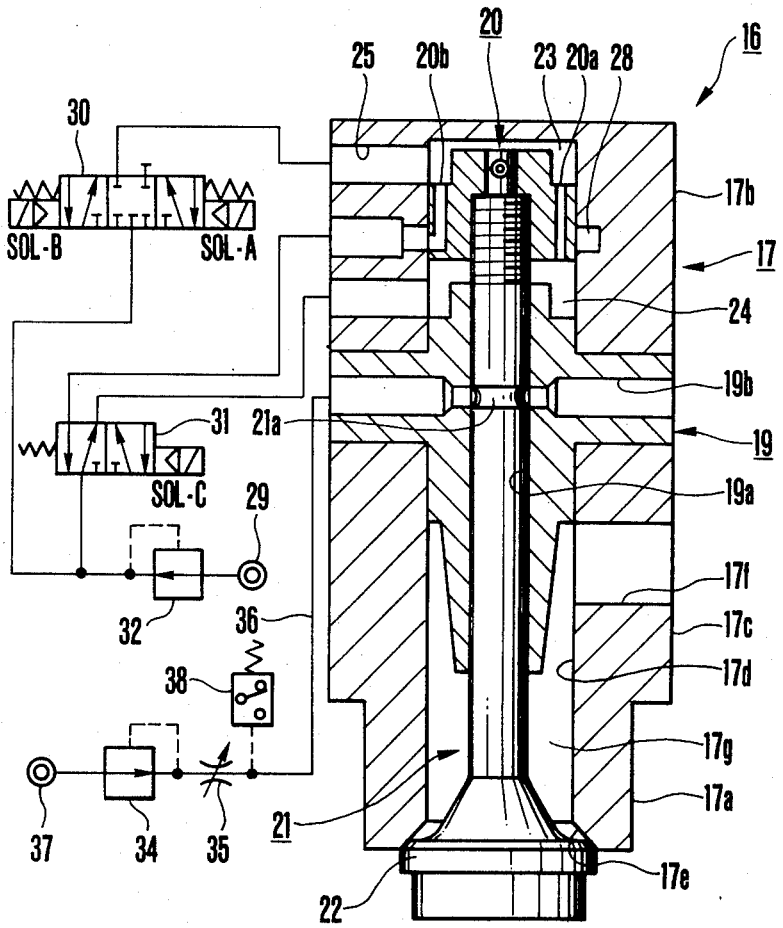

FIGS. 10 and 11 show a modification of the present invention in which a degassing apparatus is used for a metal mold of a die-cast machine. The same reference numerals in FIGS. 10 and 11 denote the same parts having the same functions as in the embodiment shown in FIGS. 1 to 4. The difference between the modification shown in FIGS. 10 and 11 and the previous embodiment is that a through hole 19*b* is formed in the valve guide 19 extending in its radial direction, and an annular groove 21*a* is formed in the upper outer peripheral surface of the valve rod 21.

More specifically, the through hole 19*b* is formed with a small-diameter portion adjacent to the valve rod 21. The position of the annular groove 21*a* is determined such that, when the valve rod 21 is at its upper position in the valve closed state, the annular groove 21*a* is aligned with the small-diameter portion of the through hole 19*b* to communicate therewith to define a fluid path through the valve, and when the valve rod 21 is in its lower position in the valve open state, the annular groove 21*a* is shifted from the through hole 19*b* in the axial direction so as not to communicate therewith.

One end of the through hole 19*b* is air-tightly connected to a pipe or conduit 36 including a reducing valve or regulator 34 and a variable throttle valve 35. The pipe 36 is connected to an air source 37. With this arrangement, when the valve rod 21 moves downward and the annular groove 21*a* is shut off from the through hole 19*b* while air is being supplied from an air source 29, since the through hole 19bis closed by the valve rod 21, the pressures in the pipe 36 and in the through hole 19*b* at the left of FIG. 10 are increased. When the valve rod 21 move upward and the annular groove 21*a* communicates with the through hole 19*b*, since the through hole 19*b* at the right of FIG. 10 is open to atmospheric pressure, the pressure in the pipe 36 is reduced. A pressure switch 38 is coupled to the pipe 36 and used as a detector for detecting a change in the pressure in pipe 36 to turn an electrical circuit on and off. The electrical circuit may include an indicator such as a pilot lamp or a buzzer so that the valve open/close operation can be signaled to an operator.

Since this pressure detector detects the valve open/-close operation and signals the operator, the valve open state can be confirmed before molten metal is injected into the die-casting machine. Since degassing in the metal molds can be reliably performed, an injection product without voids or air bubbles can always be obtained, thus greatly improving the quality of the molded product. Since the pressure detector can be situated on the die-casting machine away from high-temperature components, erroneous operation or trouble caused by heat can be minimized, thus improving reliability and durability.

During the injection operation of the degassing apparatus with the above arrangement, air from the variable throttle valve 35, the pressure of which is adjusted, is supplied to the through hole 19*b* from the air source 37. When the valve rod 21 moves downward, as shown in FIG. 10, and degassing is performed while the valve body 22 is open, since the annular groove 21*a* of the valve rod 21 moves downward and the valve rod 21 closes the through hole 19*b*, the pressure in the pipe 36 and the through hole 19*b* at the left side of FIG. 10 is increased. As shown in FIG. 11, when the valve rod 21 moves upward under the influence of the molten metal 7, the through hole 19*b* communicates with the annular groove 21*a*, and pressurized air from the air source 37 is open to the atmosphere through the through hole 19*b* at the right side of FIG. 11, thus reducing the pressure in pipe 36. since the pressure switch 38 is open and closed by an increase or decrease in the air pressure in pipe 36, the open and closed states of the valve body 22 may be confirmed if the circuit of the pressure switch 38 includes a pilot lamp or a buzzer. In this case, since the pressure switch 38 used as a detector is separated from the high-temperature cylinder 17, its temperature will not be increased. Since the valve open state of the valve body 22 can be confirmed before molten metal 7 is injected into the molding apparatus, the metal mold can be reliably degassed.

In the modification shown in FIGS. 10 and 11, the through hole 19*b* does not communicate with the annular groove 21*a* when the valve is in the valve open state, but they do communicate with each other in the valve closed state. However, when the annular groove 21*a* is formed in an upper portion, through hole 19*b* and groove 21*a* can communicate with each other in the valve open state and vice versa. Alternatively, a through hole extending through the valve rod 21 in its radial direction can be formed in place of the annular groove 21*a*. Furthermore, if a solenoid valve is provided to a detector, e.g., pressure switch 38, so that air flows only when the valve open and closed states are confirmed, compressed air may be saved. In this modification, the present invention has been exemplified with reference to the metal mold of a die-cast machine, but can be similarly applied to the metal mold of an injection molding machine.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A degassing apparatus incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a piston mounted in the bore and coupled to the communication controlling means, the piston being reciprocatingly slidable between a first position and a second position, the bore being further formed with first and second chamber situated on opposite axial sides of the piston;

the spool further including first, second and third fluid ports formed therein, the first and second ports being in communication with the first and second chambers respectively;

the piston further having formed therein a first channel interconnecting the first and second chamber, and a second channel interconnecting the third port and the first chamber when the piston is in the first position, wherein the gas inlet and outlet openings are in non-communication, the third port and the first chamber being in non-communication when the piston is in the second position, wherein the gas inlet and outlet openings are in communication.

2. A degassing apparatus incorporated with a molding apparatus as defined by claim 1, wherein the first, second and third ports are adapted to receive a pressurized gas, and wherein the first chamber has a cross-sectional area which is greater than the cross-sectional area of the second chamber to maintain the piston in the second position when equal gas pressures are supplied to the first, second and third ports.

3. A degassing apparatus incorporated with a molding apparatus as defined by claim 1, wherein the spool includes an inner wall defining the periphery of the spool bore, and wherein an annular groove is formed in the inner wall of the spool and communicating with the third port.

4. A degassing apparatus incorporated with a molding apparatus as defined by claim 1, wherein the means for selectively controlling the communication and non-communication between the gas inlet and gas outlet openings inlcudes a valve body mounted on the piston and reciprocatingly slidable within the spool bore, and a valve seat defined by the spool and situated at the gas inlet opening, the valve body being adapted to closely engage the valve seat to form a gas tight seal therewith.

5. A degassing apparatus, incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a piston mounted in the bore and coupled to the communication controlling means, the piston being reciprocatingly slidable between a first position and a second position, the bore being further formed with first and second chambers situated on opposite axial sides of the piston;

the spool further including first, second and third fluid ports formed therein, the first and second ports being in communication with the first and second chambers respectively;

the piston further having formed therein a channel, the channel being in communication with the first chamber;

the piston further including an annular groove formed in the periphery thereof, the annular groove being in communication with the channel and being in selective communication with the third port, wherein the third port and the first chamber are in communication and the gas inlet and outlet openings are in non-communication when the piston is in the first position, and wherein the third port and the first chamber are in non-communication and the gas inlet and outlet openings are in communication when the piston is in the second position.

6. A degassing apparatus incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings;

a piston mounted in the bore and coupled to the communication controlling means, the piston being reciprocatingly slidable between a first position and a second position, the bore being further formed with first and second chambers situated on opposite axial sides of the piston; and means operatively coacting on the piston for biasing the piston toward one of the first and second positions;

the spool further including first, second and third fluid ports formed therein, the first and second ports being in communication with the first and second chambers respectively;

the piston further having formed therein a channel, the channel being in communication with the third port, and being selectively in communication with one of the first chamber and the second chamber, the gas inlet and outlet openings being in non-communication when the piston is in the first position, and being in communication when the piston is in the second position.

7. A degassing apparatus incorporated with a molding apparatus as defined by claim 6, wherein the piston biasing means includes a compression spring mounted in the second chamber, the compression spring exerting a force on the piston to bias the piston in a direction towards the first position.

8. A degassing apparatus incorporated with a molding apparatus as defined by claim 6, wherein the piston biasing means includes a compression spring mounted in the first chamber, the compression spring exerting a force on the piston to bias the piston in a direction towards the second position.

9. In combination:

(a) a degassing apparatus incorporated with a molding apparatus, the degassing apparatus including a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a piston mounted in the bore and coupled to the communication controlling means, the piston being reciprocatingly slidable between a first position and a second position, the bore being further formed with first and second chambers situated on opposite axial sides of the piston;

the spool further including first, second and third fluid ports formed therein, the first and second ports being in communication with the first and second chambers respectively;

the piston further having formed therein a first channel interconnecting the first and second chamber, and a second channel interconnecting the third port and the first chamber when the piston is in the first position, wherein the gas inlet and outlet openings are in non-communication, the third port and the first chamber being in non-communication when the piston is in the second position, wherein the gas inlet and outlet openings are in communication; and (b) means for effecting movement of the piston between the first and second positions, the piston movement effecting means including means for selectively applying a pressurized fluid to at least one of the first, second and third ports.

10. The combination defined by claim 9 wherein the means for selectively applying a pressurized fluid includes a first switching valve and a second switching valve, the first switching valve being coupled to the first port and adapted to selectively provide to the first port at least one of a pressurized fluid and a fluid at atmospheric pressure, and being adapted to selectively close the first port to form a substantially gas tight seal therewith, the second switching valve being coupled to the second and third ports and being adapted to selectively provide to the second and third ports at least one of a pressurized fluid and a fluid at atmospheric pressure.

11. The combination defined by claim 9 wherein the means for selectively applying a pressurized fluid includes a switching valve coupled to at least one of the first, second and third ports for selectively supplying a pressurized fluid to the respective port, and wherein the means for effecting movement of the piston includes an electronic control circuit, the electronic control circuit being responsive to an electrical control signal indicative of a predetermined event occurring in the operation of the molding apparatus, and providing an output signal to the switching valve, the switching valve being responsive to the output signal from the electronic control circuit to provide the pressurized fluid to the respective port to cause the piston to move in a direction toward one of the first position and the second position.

12. A gas-venting arrangement incorporated with a mold including stationary and movable mold portions, together defining a mold cavity to be filled with a molten material, the gasventing arrangement comprising:

(a) a degassing apparatus, the degassing apparatus including a spool, the spool having a first end portion adapted to be coupled to the molding apparatus, the first end portion of the spool having a gas inlet opening formed therein and adapted to be in communication with the mold cavity, and a gas exhaust hole formed therein, the spool having an inner bore formed therein:

a valve guide member mounted on the spool, the valve guide member including a bore formed therethrough;

a valve rod mounted on the valve guide member and reciprocatingly slidable within the valve guide bore, the valve rod having opposite axial ends;

a valve body mounted on one axial end of the valve rod, the gas inlet opening defining a valve seat, the valve body being adapted to closely engage the valve seat and to form a gas tight seal therewith;

a psiton mounted on the other axial end of the valve rod and closely received by the spool inner bore, the piston being reciprocatingly slidable within the inner bore, the piston having opposite first and second axial sides, the inner bore including first and second chambers situated on the first and second piston axial sides respectively, the piston further including a channel formed therein; interconnecting said first and second chambers the spool further having formed therein first, second and third fluid ports, the first and second ports being in communication with the first and second chambers respectively;

the piston being selectively positionable in a first position, wherein the valve body closely engages the valve seat and the third port is in communication with the first chamber, and a second position, wherein the valve body is disengaged from the valve seat and the third port is in non-communication with the first chamber;

(b) a gas vent groove communicating with the spool bore and formed in said mold to communicate with the mold cavity; and (c) at least one bypass conduit branched from the gas vent groove and selectively in communication with the gas exhaust hole, wherein the bypass conduit and the gas vent groove are in non-communication with the gas exhaust hole when the valve body closely engages the valve seat, and wherein the bypass conduit and the gas vent groove are in communication with the gas exhaust hole when the valve body is disengaged from the valve seat.

13. A degassing apparatus incorporated with a molding apparatus, the molding apparatus having a mold cavity into which a molten material is injected, the degassing apparatus comprising:

a spool, the spool having a first end portion adapted to be coupled to the molding apparatus, the first end portion of the spool having a gas inlet opening formed therein and adapted to be in communication with the mold cavity, and a gas exhaust hole formed therein, the spool having an inner bore formed therein;

a valve guide member mounted on the spool, the valve guide member including a bore formed therethrough;

a valve rod mounted on the valve guide member and reciprocatingly slidable within the valve guide bore, the valve rod having opposite axial ends;

a valve body mounted on one axial end of the valve rod, the gas inlet opening defining a valve seat, the valve body being adapted to closely engage the valve seat and to form a gas tight seal therein; and a piston mounted to the other axial end of the valve rod and closely received by the spool inner bore, the piston being reciprocatingly slidable within the inner bore, the piston having opposite first and second axial sides, the inner bore including first and second chambers situated on the first and second piston axial sides respectively, the piston further including a channel formed therein; interconnecting said first and second chambers;

the spool further having formed therein first, second and third fluid ports, the first and second ports being in communication with the first and second chambers respectively;

the piston being selectively positionable in a first position, wherein the valve body closely engages the valve seat and the third port is in communication with the first chamber, and a second position, wherein the valve body is disengaged from the valve seat and the third port is in non-communication with the first chamber.

14. A degassing apparatus incorporated with a molding apparatus as defined by claim 13, wherein partial movement of the piston from the second position toward the first position, effected by molten material impinging the valve body, causes the third port and the first chamber to be in communication.

15. A degassing apparatus incorporated with a molding apparatus as defined by claim 13, which further includes:

means for detecting movement of the valve body, the movement detecting means including a through hole formed in the valve guide member and having first and second through hole portions extending radially therethrough and communicating with the valve guide bore;

a fluid passage formed on or in the valve rod, the passage being in communication with the first and second through hole portions when the passage is aligned with the through hole portions;

the through hole being adapted to receive a pressurized fluid on the first portion thereof, the second portion being open to atmospheric pressure, wherein the pressure in the first through hole portion is greater than atmospheric pressure when the through hole portions are in non-alignment with the rod passage, and wherein the first through hole portion is at a reduced pressure when the through hole portions are aligned with the rod passage; and means for detecting a change in the pressure of the through hole, the pressure detecting means being communicatively coupled to the first through hole portion and being responsive to a change in pressure in the through hole to provide a signal indicating the pressure change.

16. A degassing apparatus incorporated with a molding apparatus having a mold cavity, which comprises:

a spool having a bore formed therein, the spool further having formed therein a gas inlet opening adapted to be communicatively coupled to the mold cavity of the molding apparatus, and a gas outlet opening, the gas inlet and outlet openings being in selective communication and non-communication with each other;

means for selectively controlling the communication and non-communication between the gas inlet and gas outlet openings; and a piston mounted in the bore and coupled to the communication controlling means, the piston being reciprocatingly slidable between a first position and a second position, the bore being further formed with first and second chambers situated on opposite axial sides of the piston;

the spool further including first, second and third fluid ports formed therein, the first and second ports being in communication with the first and second chambers respectively;

the spool further including an inner wall defining the periphery of the spool bore, the spool having an annular groove formed in the inner wall, the groove having substantially the same width as the axial length of the peripheral edge of the piston, the annular groove being in communication with the third port, wherein the third port communicates with the first chamber and the first port through the annular groove when the piston is in the second position, and wherein the third port communicates with the second chamber and the second port through the annular groove when the piston is in the first position.

* * * * *